US005887232A

United States Patent [19]

Phillips et al.

[11] Patent Number: 5,887,232

[45] Date of Patent: Mar. 23, 1999

[54] APPARATUS FOR DISPENSING TONER IN AN ELECTROPHOTOGRAPHIC PRINTING SYSTEM

[75] Inventors: Quintin T. Phillips; K. Trent Christensen; Richard F. Beaufort, all of Boise; Robin P. Yergenson, Eagle, all of Id.

[73] Assignee: Hewlett-Packard Company, Palo Alto, Calif.

[21] Appl. No.: 569,442

[22] Filed: Dec. 8, 1995

[51] Int. Cl.[6] ..... G03G 15/08

[52] U.S. Cl. ..... 399/262; 399/106; 399/119; 222/DIG. 1

[58] Field of Search ..... 355/245, 260; 141/363–366, 329–330; 222/DIG. 1, 325, 143; 206/515, 499, 518, 519, 516; 399/106, 119, 120, 258, 260, 262

[56] References Cited

U.S. PATENT DOCUMENTS

| | | | |
|---|---|---|---|
| 4,816,877 | 3/1989 | Keen | 355/133 |
| 4,930,684 | 6/1990 | Patterson | 222/325 |
| 5,034,776 | 7/1991 | Sugiura | 355/260 |
| 5,185,616 | 2/1993 | Wilcke . | |
| 5,341,196 | 8/1994 | Hodoshima et al. | 355/260 |
| 5,392,963 | 2/1995 | Kelly et al. | 222/325 |

FOREIGN PATENT DOCUMENTS

| | | | |
|---|---|---|---|
| 63-002086 | 1/1988 | Japan | 355/260 |
| 63-187272 | 8/1988 | Japan | 355/260 |

*Primary Examiner*—Matthew S. Smith
*Attorney, Agent, or Firm*—Gregg W. Wisdom

[57] ABSTRACT

An apparatus for dispensing toner in an electrophotographic printing system includes a housing for containing a supply of toner and toner filled containers for replenishing the supply of toner. Toner is allowed to flow to a developer assembly in the electrophotographic printing system by removal of a housing toner seal. The bottom of the container is dimensioned so that it can be inserted through the opening in the top of the housing and the opening in the top of another substantially identical container. A toner dam seal is attached to the container to close the bottom opening. In the preferred embodiment, the toner dam seal includes a length of flexible material for use in removal of the toner dam seal. In an alternative embodiment, cutting blades are attached to the interior of the sidewalls of both the housing and the container for cutting the toner dam seal upon installation of the container into the housing or into a previously installed container.

21 Claims, 14 Drawing Sheets

APPARATUS FOR DISPENSING TONER IN AN ELECTROPHOTOGRAPHIC PRINTING SYSTEM

TECHNICAL FIELD OF THE INVENTION

The present invention relates to toner dispensing systems, and more particularly to a toner dispensing apparatus which allows for replenishment of a depleted toner supply in an electrophotographic printing system.

BACKGROUND OF THE INVENTION

Electrophotographic processes for producing a permanent image on media are well known and commonly used. In general, these processes all include: (1) charging a photoreceptor which is a drum or continuous belt bearing a photoconductive material; (2) producing an electrostatic latent image by exposing the charged area to a light image or a light emitting diode array, or scanning the charged area with a laser beam; (3) presenting particles of toner to the photoreceptor surface upon which the electrostatic latent image is disposed so that the particles are transferred to the electrostatic latent image; (4) transferring the particles from the photoreceptor to the media while maintaining the shape of the image formed on the photoreceptor drum; (5) fusing or fixing the particles in the shape of the image to the media; and (6) cleaning or restoring the photoreceptor for the next printing cycle.

Referring to FIG. 1, the electrophotographic printer 300 of the prior art has therein feed rollers 321 and 322 for feeding the printing sheets stacked in the printing sheet cassettes 311 and 312, a pair of rollers 323 for conveying a printing sheet fed from the printing sheet cassettes 311 or 312, an exposure array 376 for emitting light to the photosensitive drum 52 for forming an electrostatic latent image on the photosensitive drum 52, a transfer electrostatic charger 327 for transferring toner from the photoconductive drum 52 to the printing sheet, a pair of heat rollers 328 for fixing the toner transferred on the printing sheet and a prior art electrophotographic cartridge 50. The prior art electrophotographic cartridge 50 is not designed for replenishment of the toner supply.

The electrophotographic cartridge 50 has an electrostatic charger 84 for electrostatically charging the photoconductive drum 52 uniformly, a developer assembly 54 for applying toner to the electrostatic latent image formed on the photoconductive drum 52 after exposure to the exposure array 376, and a cleaner 76 for removing the untransferred toner which remains on the photoconductive drum 52 after the transfer step. The untransferred toner is stored in waste hopper 85. Electrostatic charger 84 may be a charge roller assembly or a corona assembly. Further information about alternative photographic processes is available in the text "The Physics and Technology of Xerographic Processes", by Edgar M. Williams, 1984, a Wiley-Interscience Publication of John Wiley & Sons, the disclosure of which is hereby incorporated by reference.

Many image forming apparatus utilize the electrophotographic printing process, examples being laser printers, copy machines, and facsimile machines. As described above, these image forming apparatus use toner to print or copy the desired image or words onto a piece of paper or media. The toner is contained in a reservoir which is depleted as a result of printing. For example, the toner in a laser printer is generally depleted after printing from 2,000 to 10,000 pages depending upon the initial supply of toner in the reservoir and the coverage of the text or graphics images printed.

Some electrophotographic printing systems, such as copy machines, are designed to allow recharging of the toner reservoir. On these electrophotographic printing systems, an access port to the toner reservoir has been included to allow an operator to recharge the toner reservoir. Typically, toner is supplied in bottles and the operator is required to pour the toner into the toner reservoir to recharge the printing system. This creates the potential for contamination of the recharged toner supply and the potential for spillage of the toner during the recharging process. Contamination of the recharged toner supply can cause a degradation in the print quality delivered by the printing system either directly as a result of the contamination or through interaction with electrophotographic printing components. Spillage of toner and the possible subsequent soiling of hands, clothes, papers, and office equipment results in customer dissatisfaction.

Electrophotographic printers are typically designed so that the components involved in actually accomplishing electrophotographic printing are contained in a disposable electrophotographic print cartridge. The components usually included in the cartridge are the photoconductor drum, the drum charging assembly, such as the charge roller assembly or the corona assembly, the developer assembly, the drum cleaning blade, and the supply of toner used for forming the print text or print images. The supply of toner is contained in a toner reservoir. The useable life of the cartridge is limited by the available supply of toner in the toner reservoir and the useable life of the cartridge components, particularly the photoconductor, the developer assembly, and the drum charging assembly. Practically, limitations on the size and weight of the cartridge, which limit the supply of toner, most significantly limit the useable life of the cartridge. Cartridge components are designed to perform acceptably well for print cycles beyond the number at which the toner is consumed. The organic photoconductor drum, which is in contact with the media during printing, usually is the first of the cartridge components to fail because of wear. Typically, no provision for refilling the toner reservoir of the cartridge is included in the design of the cartridge. Upon exhaustion of the toner supply in the cartridge, it is necessary to replace the empty cartridge with one having the reservoir filled with toner.

An electrophotographic printer which allows recharging of the toner reservoir easily and with a greatly reduced risk of spillage would provide the motivation for the development of electrophotographic components with an extended operating life to exploit the refilling capability. Because electrophotographic cartridges are relatively expensive, this would allow a significant reduction in the average cost per printed page resulting from the extended operating life.

Disposal of exhausted electrophotographic cartridges contributes to the consumption of available landfill space. An additional benefit of cartridge toner recharging capability would be a reduction in the volume of solid waste generated through the use of electrophotographic cartridges.

SUMMARY OF THE INVENTION

A first container for containing toner to be installed in an apparatus for dispensing toner to replenish the toner supply has a sidewall, a top having a first opening, and a bottom having a second opening. The first opening is covered by a top seal attached to the first container and the second opening is covered by a toner dam seal attached to the first container. The first opening of the first container has dimensions which allow the bottom of a substantially identical second container to pass through the first opening of the container so that the bottom opening of the second container can be installed in the first container to replenish the toner supply of the apparatus for dispensing toner when the first container is depleted of toner.

The apparatus for dispensing toner has a housing for containing toner. The housing for containing toner has a first sidewall, a first top having a first opening, and a first bottom having a second opening. The first opening is covered by a top cover attached to the housing and the second opening is covered by a removable housing toner seal attached to the housing. When the housing is depleted of toner, a first container having a second sidewall, a second top having a third opening, and a second bottom having a fourth opening is installed through the first opening of the housing to replenish the toner supply. The first container has an attached openable top seal for closing the third opening and an attached toner dam seal for closing the fourth opening.

The third opening of the first container is dimensioned to permit the second bottom of a second container, substantially identical to the first container, to be inserted through the third opening of the first container when the first container installed in the housing is depleted of toner.

Replenishing the toner supply in an apparatus for dispensing toner is accomplished by forcing a container into the top cover of the housing thereby splitting the top cover at a weakened seam in the top cover. The container is pushed through the top cover and seated inside the housing.

DESCRIPTION OF THE DRAWINGS

A more thorough understanding of the invention may be had from the consideration of the following detailed description taken in conjunction with the accompanying drawings in which.

DETAILED DESCRIPTION OF THE INVENTION

Figure 1:
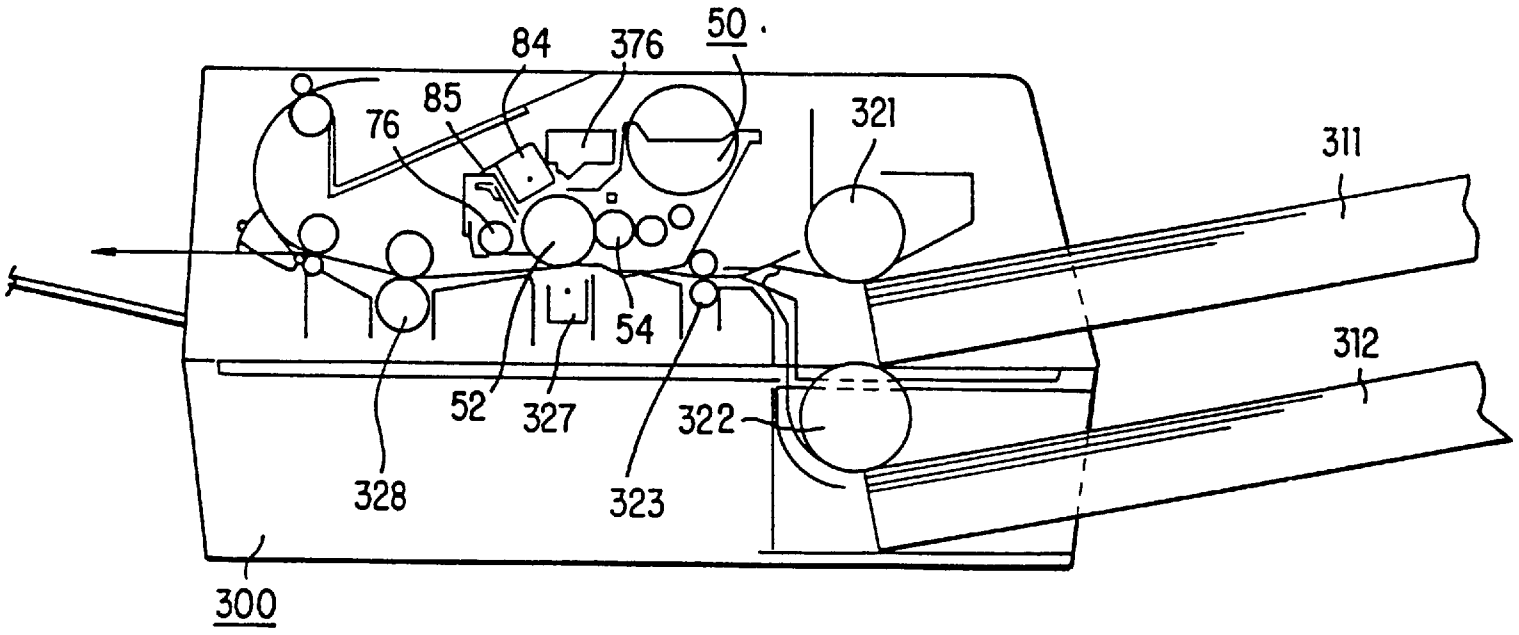
FIG. 1 PRIOR ART
FIG. 1 is a schematic representation of an electrophotographic printer showing a prior art electrophotographic cartridge installed in the printer.
Figure 1A:
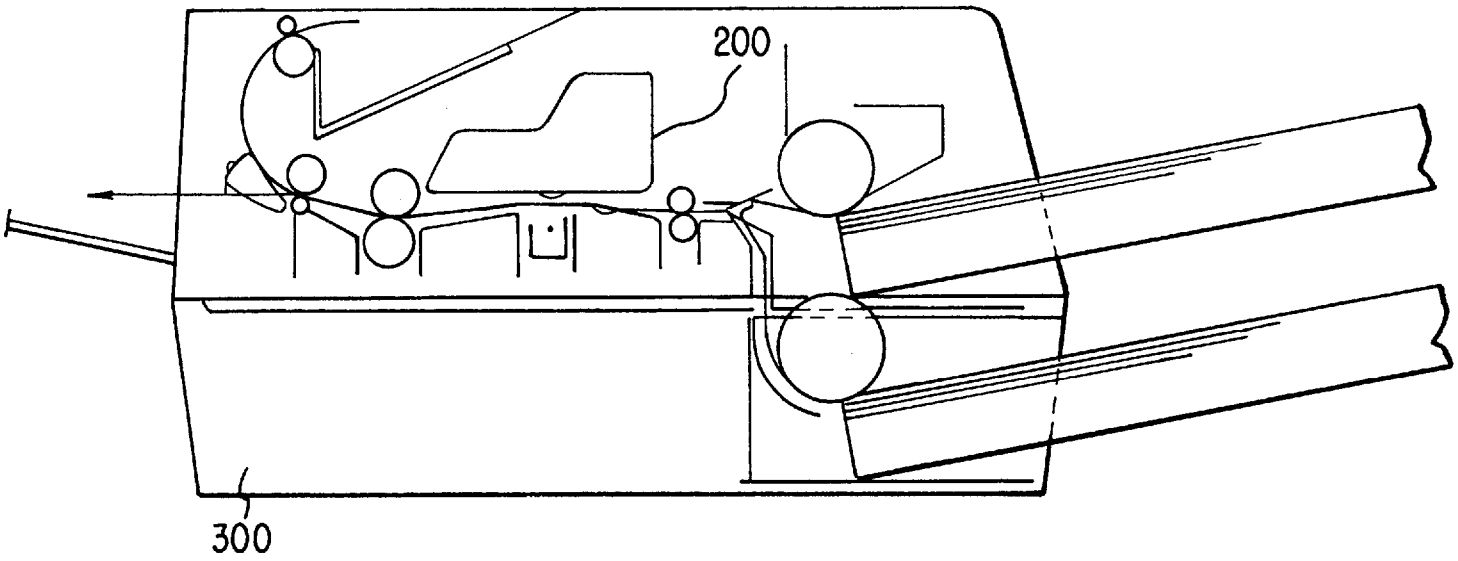
FIG. 1*a* is a schematic representation of an electrophotographic printer showing an electrophotographic cartridge which contains an embodiment of the apparatus for dispensing toner.
Figure 2:
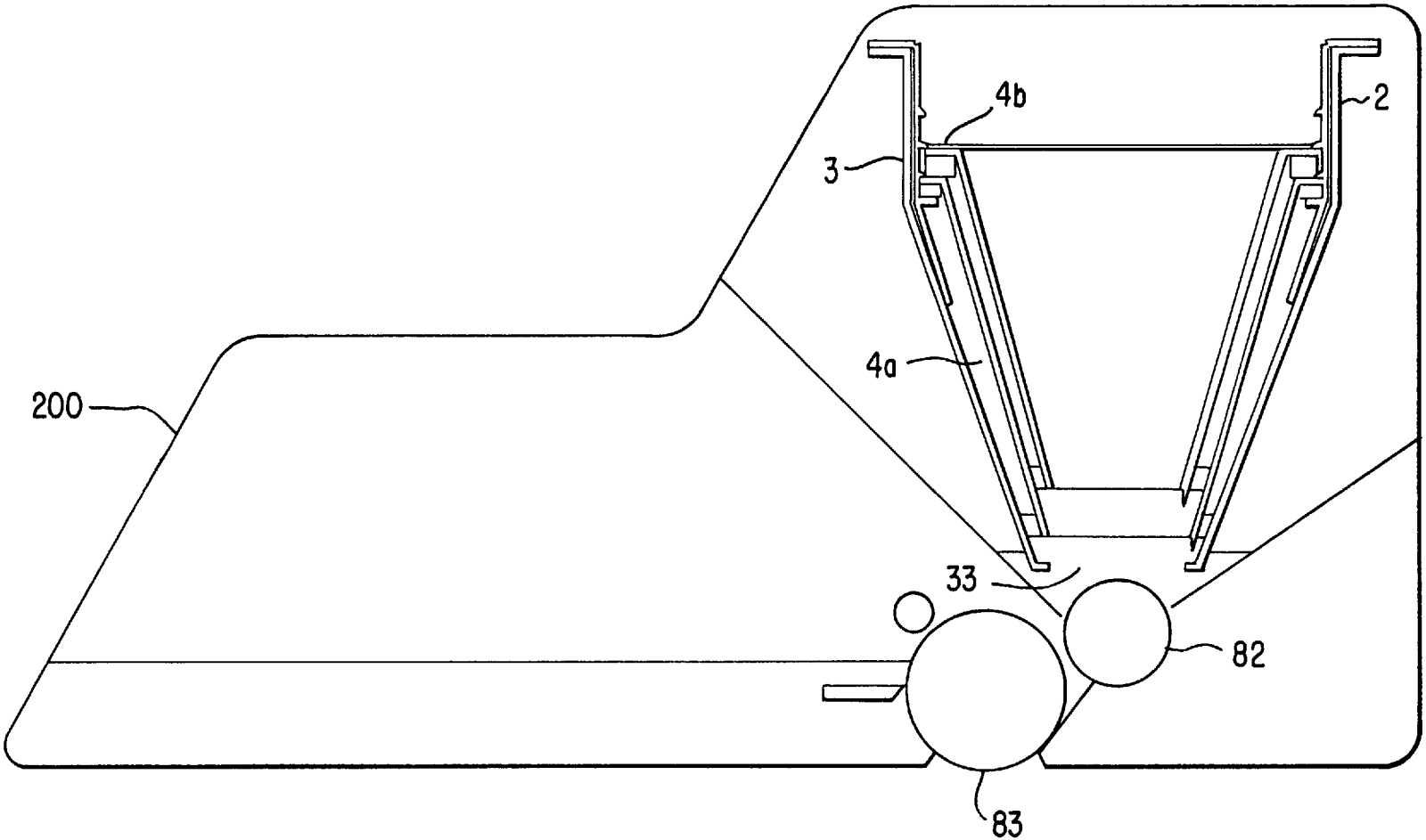
FIG. 2 is a cross sectional schematic representation of an embodiment of the apparatus for dispensing toner using a plurality of replenishment containers installed inside of an electrophotographic cartridge.

The present invention is not limited to the specific exemplary embodiment illustrated herein. FIG. 1*a* is a simplified diagram showing an electrophotographic cartridge 200 containing the apparatus for dispensing toner of this embodiment installed in electrophotographic printer 300. FIG. 2 is a simplified diagram of an electrophotographic cartridge 200 including the apparatus for dispensing toner 2 of this embodiment. The apparatus for dispensing toner 2 of this embodiment includes a housing 3 into which the substantially identical containers 4*a*, 4*b* for replenishing the toner supply to the developer assembly 5 are installed. It is recognized that the apparatus for dispensing toner 2 of this embodiment can be implemented to accommodate an arbitrary number of containers and that the depiction of two containers in the drawings with this specification is only for illustrative purposes. Toner is supplied to the developer assembly 82 through the bottom opening 33 of housing 3.

FIG. 2 depicts a container 4*a* and a container 4*b* installed in housing 3. Initially, prior to installation of container 4*a*, housing 3 is filled with toner. This is the configuration in which electrophotographic cartridge 200 is delivered to the end user. Printing is accomplished using toner contained in housing 3 until depletion. After depletion of toner in housing 3, the toner supply is replenished by the installation of first container 4*a* into the now empty interior region of housing 3. The volume of toner in the replenishment containers will be less than that originally contained in housing 3. After depletion of container 4*a*, the toner supply is replenished by the installation of container 4*b* into the now empty interior region of container 4*a*. Successive replenishment containers, in addition to container 4*a* and container 4*b*, may be installed in the apparatus for dispensing toner 2 of this embodiment.

The apparatus for dispensing toner 2 of this embodiment is designed to hold three replenishment containers. Containers 4*a*, 4*b* are designed to remain in place once installed in housing 3. When the useful life of electrophotographic cartridge 200 is exhausted, it, including containers 4*a*, 4*b*, is removed from electrophotographic printer 300 and delivered for recycling. One skilled in the art will recognize that the total useful number of replenishment containers which may be installed in electrophotographic cartridge 200 is limited by the physical size of the containers, the amount of space available in electrophotographic cartridge 200, and the operating life limitations of the electrophotographic components. One skilled in the art will further recognize that the apparatus for dispensing toner 2 of this embodiment is useable with any electrophotographic printing system, such as a fax machine or a photocopying machine, in addition to an electrophotographic printer.

Figure 9:
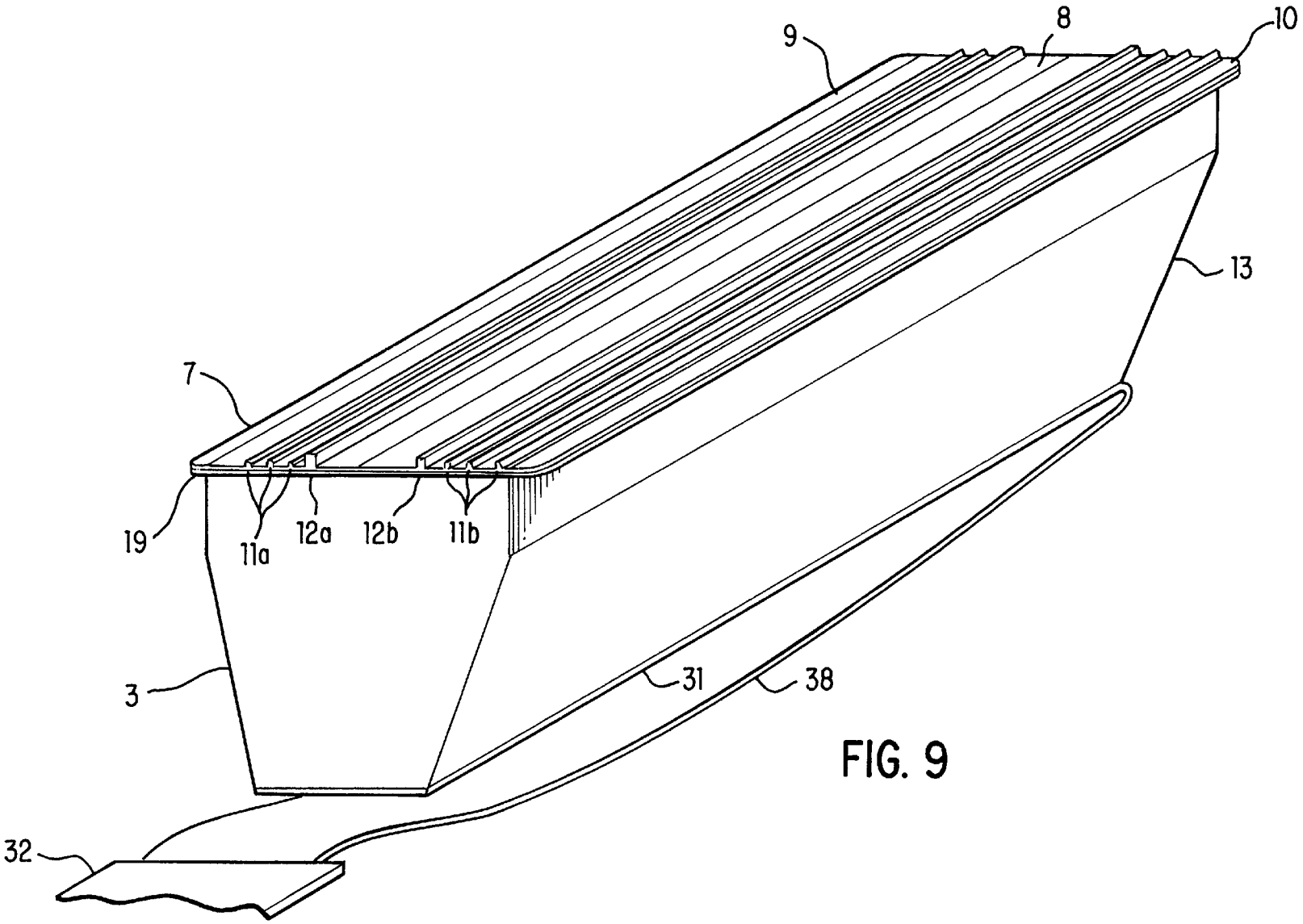
FIG. 9 is a perspective view of the apparatus for dispensing toner prior to installation of the first replenishing container.

FIG. 9 is a perspective view of housing 3 prior to the installation of container 4*a*. Housing 3 of FIG. 9, installed in electrophotographic cartridge 200, is the configuration which is delivered to the user. Housing 3 includes sidewall 13 for enclosing the initial amount of toner provided and replenishment containers filled with toner. Top cover 7 prevents toner leakage from the top of housing 3. Before the apparatus for dispensing toner 2 of this embodiment can be used in electrophotographic cartridge 200 for printing, housing toner seal 31 must be removed to allow toner to flow out of housing 3 and reach developer assembly 82. In the preferred embodiment, housing toner seal 31 is comprised of a flexible plastic material, such as MYLAR. Also in the preferred embodiment, housing toner seal 31 includes an additional first length of flexible plastic material 38 with an attached tab 32, preferably comprised of a hard plastic material such as polyethylene. Removal of housing toner seal 31 is accomplished by firmly pulling on tab 32, which protrudes from a slot in electrophotographic cartridge 200, to separate housing toner seal 31 from housing 3.

Upon depletion of the initial amount of toner provided in housing 3, the toner supply is replenished by positioning container 4*a* over top cover 7 and forcing container 4*a* into top cover 7. This forcing action splits top cover 7 at weakened seam 8 into two pieces. As container 4*a* is forced through the split in top cover 7, the two pieces of top cover 7 bend downward at hinges 9 and 10 into the interior of housing 3. Hinges 9 and 10 are formed by grooves in top cover 7. In the preferred embodiment, housing 3 and replenishment containers are constructed of a plastic material, such as polyethelyne or polystyrene. However, one skilled in the art will recognize that other materials, such as aluminum or steel may be used to construct housing 3 and replenishment containers. Because replenishment container 4*a* is installed only when the initial amount of toner contained in housing 3 is depleted, there will not be compaction of toner resulting from the installation of container 4*a* into housing 3.

Figure 5:
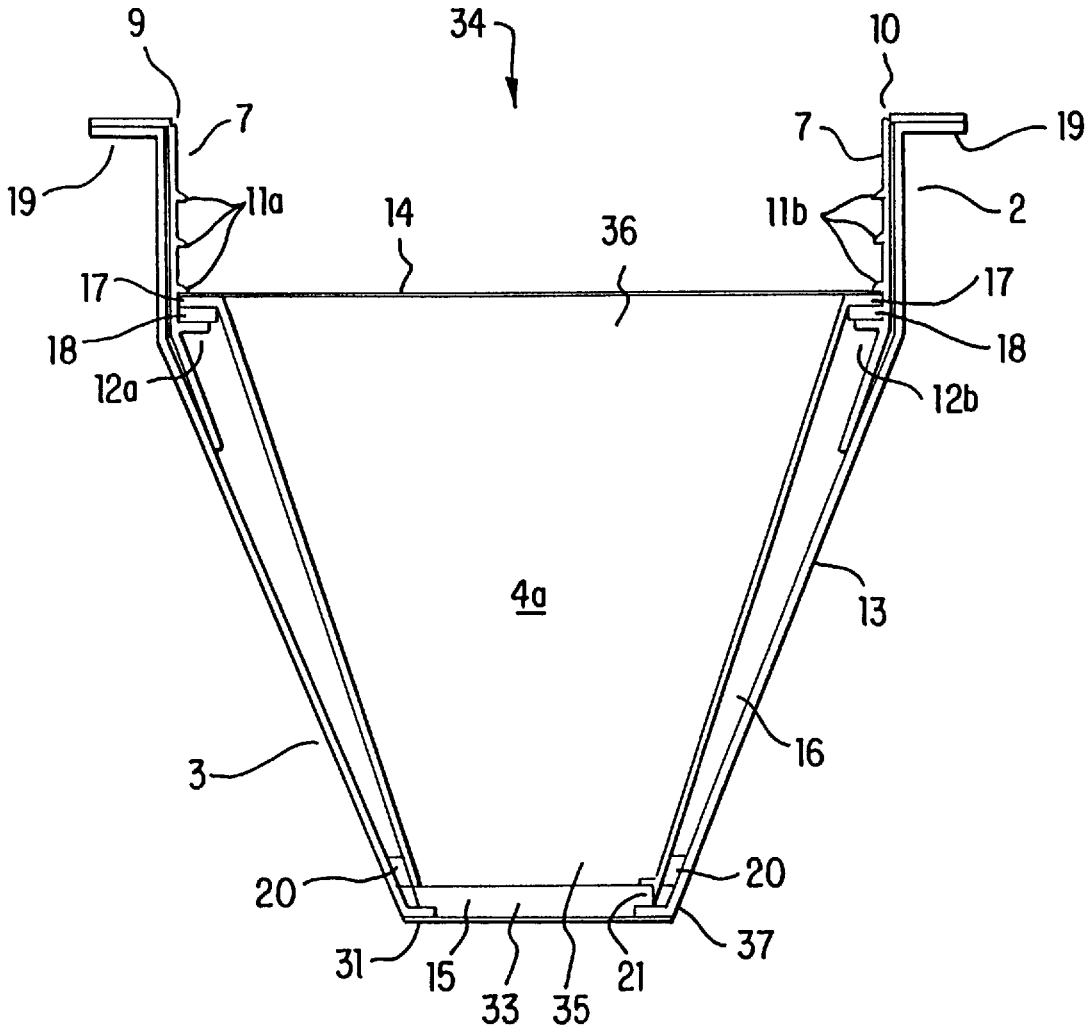
FIG. 5 is a cross section of an embodiment of the apparatus for dispensing toner.

FIG. 5 depicts a detailed cross section of the apparatus for dispensing toner 2 of this embodiment, separated from electrophotographic cartridge 200 and with container 4*a* installed. Housing 3 has a bottom opening 33 and a top opening 34. Container 4*a* has a bottom opening 35 and a top opening 36. In this depiction, the two pieces of top cover 7 have been bent downward at hinges 9 and 10 as a result of forcing container 4*a* into housing 3. Container 4*a* has been seated past the bottom most of locking ridges 11*a*, 11*b* onto inner flanges 12*a*, 12*b* of top cover 7. Locking ridges 11*a*, 11*b* serve to lock container 4*a* into place in housing 3. In addition, the two pieces of top cover 7 are flexed when pressed against sidewall 13 of housing 3 by container 4*a*, serving to provide a force to keep container 4*a* in place. In the preferred embodiment, weakened seam 8 bisects top cover 7 to form two pieces of equal size. Also in the preferred embodiment, locking ridges 11*a*, 11*b* and inner flange 12*a*, 12*b* are integrally formed in top cover 7 of housing 3, span the length of top cover 7, and are symmetrically located on either side of weakened seam 8, with inner flange 12*a*, 12*b* being closer than locking ridges 11*a*, 11*b* to weakened seam 8. However, one skilled in the art will recognize that locking ridges 11*a*, 11*b* and inner flange 12*a*, 12*b* may be joined to top cover 7 using a thermal process or an ultrasonic process. One skilled in the art will further recognize that it is not necessary for locking ridges 11*a*, 11*b* to span the entire length of top cover 7, segments of ridges over part of the length of top cover 7 could be used. Additionally, one skilled in the art will recognize that it is not necessary that weakened seam 8 be located along the center of top cover 7 and it is not necessary that locking ridges 11*a*, 11*b* and inner flange 12*a*, 12*b* be located symmetrically about weakened seam 8. In the preferred embodiment a thermal bonding process is used to attach top cover 7 to top housing flange 19. Alternatively, an ultrasonic process may be used in the attachment of top cover 7 to top housing flange 19.

In FIG. 5 housing toner seal 31 is shown attached to bottom housing flange 37. It will be recognized by one skilled in the art that with normal operation of the apparatus for dispensing toner 2 of this embodiment, housing toner seal 31 would be removed at the time at which container 4*a* is installed in housing 3. Housing toner seal 31 is shown to be present for illustrative purposes. In the preferred embodiment, housing toner seal 31 is attached to bottom housing flange 37 using an ultrasonic process. Alternatively, a thermal bonding process may used for attachment or housing toner seal 31 may be adhesively attached to bottom housing flange 37.

Top seal 14 covers container 4*a* to prevent toner flow from the top of container 4*a*. The bottom of container 4*a* is covered by toner dam seal 15 which prevents toner flow out of the bottom of container 4*a*. Toner dam seal 15 is removable. Toner dam seal 15 is removed upon installation of container 4*a* into housing 3 to allow gravity flow of toner to developer assembly 82.

Sidewall 16 of container 4*a* is sloped inward from the top of container 4*a* toward the bottom of container 4*a* so that the dimensions of container 4*a* at a cross section at the bottom are less than the corresponding dimensions at a cross section at the top of container 4*a*. This relationship between the dimensions of the cross sections at the top and bottom of container 4*a* allows successive containers to be placed inside the previously depleted container to replenish the toner supply to the developer assembly 82.

In the preferred embodiment, container 4*a* has a trapezoidal vertical cross section as depicted in FIG. 5 and is of sufficient length to span the length of developer assembly 82 used to develop toner onto photoconductor drum 83, resulting in an overall wedge shape for container 4*a*. However, one skilled in the art will recognize that a variety of vertical cross section shapes of replenishment containers may be used which would allow the bottom opening of replenishment containers to be installed inside housing 3 to pass through the top opening of the previously depleted replenishment container.

The term "stacked", as used in this specification, refers to the condition in which a second container is disposed inside a first container, substantially identically shaped as the second container, so that the exterior of the sidewall of the second container is in close proximity with the interior of the sidewall of the first container over substantially all of exterior surface area of the sidewall of the second container inside of the first container. To provide the ability to successively stack substantially identically shaped containers, it is necessary that the distance, as measured between the outsides of the sidewall, between any two locations on opposite sidewalls of the container, of a given horizontal cross section of the container between the top and bottom of the container, be less than the distance, as measured between the insides of the sidewall, between the corresponding locations on opposite sidewalls of any horizontal cross section above the given horizontal cross section. The term "substantially identical containers", as used in this specification, refers to containers which are of identical design with respect to the significant features and have differences in their characteristics only to the degree that these differences lie within the normal manufacturing distribution of these characteristics.

Although the preferred embodiment of the apparatus for dispensing toner 2 utilizes stackable containers to minimize the volume occupied by the stacked containers, one skilled in the art will recognize that it is not necessary to use containers which are stackable, as the term has been defined herein. Any container having a bottom opening of dimensions of sufficient size so that it can pass through the top opening of another substantially identically shaped container could be employed in the apparatus for dispensing toner 2. It is not necessary that the exterior of the sidewall of the second container be in contact with the interior of the sidewall of the first container over substantially all of the exterior of the sidewall of the second container to accomplish the dispensing of toner.

Referring to FIG. 5, sidewall 16 of container 4*a* has an attached outer flange 17. In the preferred embodiment, outer flange 17 is integrally formed with sidewall 16. Attached to the bottom surface of outer flange 17 is top toner seal 18. When container 4*a* is installed in housing 3 so that outer flange 17 is located below the bottom most of locking ridges 11*a*, 11*b*, top toner seal 18 is disposed upon inner flange 12*a*, 12*b*. This inhibits the flow of toner between inner flange 12*a*, 12*b* and outer flange 17.

In the preferred embodiment, top toner seal 18 is comprised of a felt material attached to the bottom surface of outer flange 17. However, one skilled in the art will recognize that a variety of resilient materials, for example urethane foam, would be suitable for top toner seal 18. In the preferred embodiment, top toner seal is adhesively attached to the bottom surface of outer flange 17. However, depending upon the material used to construct top toner seal 18, it may be attached through an ultrasonic process or through a thermal bonding process.

Top toner seal 18 covers substantially the entire bottom surface of outer flange 17. Top toner seal 18 provides sealing to inhibit toner from migrating between outer flange 17 and inner flange 12*a*, 12*b*. In the preferred embodiment, a bottom toner seal 20 is attached to container 4*a* adjacent to the bottom edge of sidewall 16 enclosing the perimeter of container 4*a* and is comprised of a strip of a felt material. In the preferred embodiment, bottom toner seal 20 is adhesively attached to sidewall 16. One skilled in the art will recognize that a variety of resilient materials, for example urethane foam, would be suitable for bottom toner seal 20. In addition, depending upon the material used to construct bottom toner seal 20, it may be attached through an ultrasonic process or through a thermal bonding process. Bottom toner seal 20 encloses the perimeter of container 4*a* adjacent to the bottom edge of sidewall 16. Bottom toner seal 20 inhibits toner from migrating between the exterior of sidewall 16 and the interior of sidewall 13 of housing 3.

Top seal 14 is comprised of a flexible material, preferably a clear plastic material such as MYLAR. When container 4*a* installed in housing 3 becomes depleted of toner, container 4*b* can be installed to replenish the supply of toner for developer assembly 82 as shown in FIG. 2. Sharp edge 21, attached to the bottom edge of part of sidewall 16, is used to assist in the installation of the replacement container 4*b*. In the preferred embodiment, sharp edge 21 is integrally formed in sidewall 16, although it may be a separate piece attached ultrasonically, adhesively, or through thermal bonding.

Figure 3:
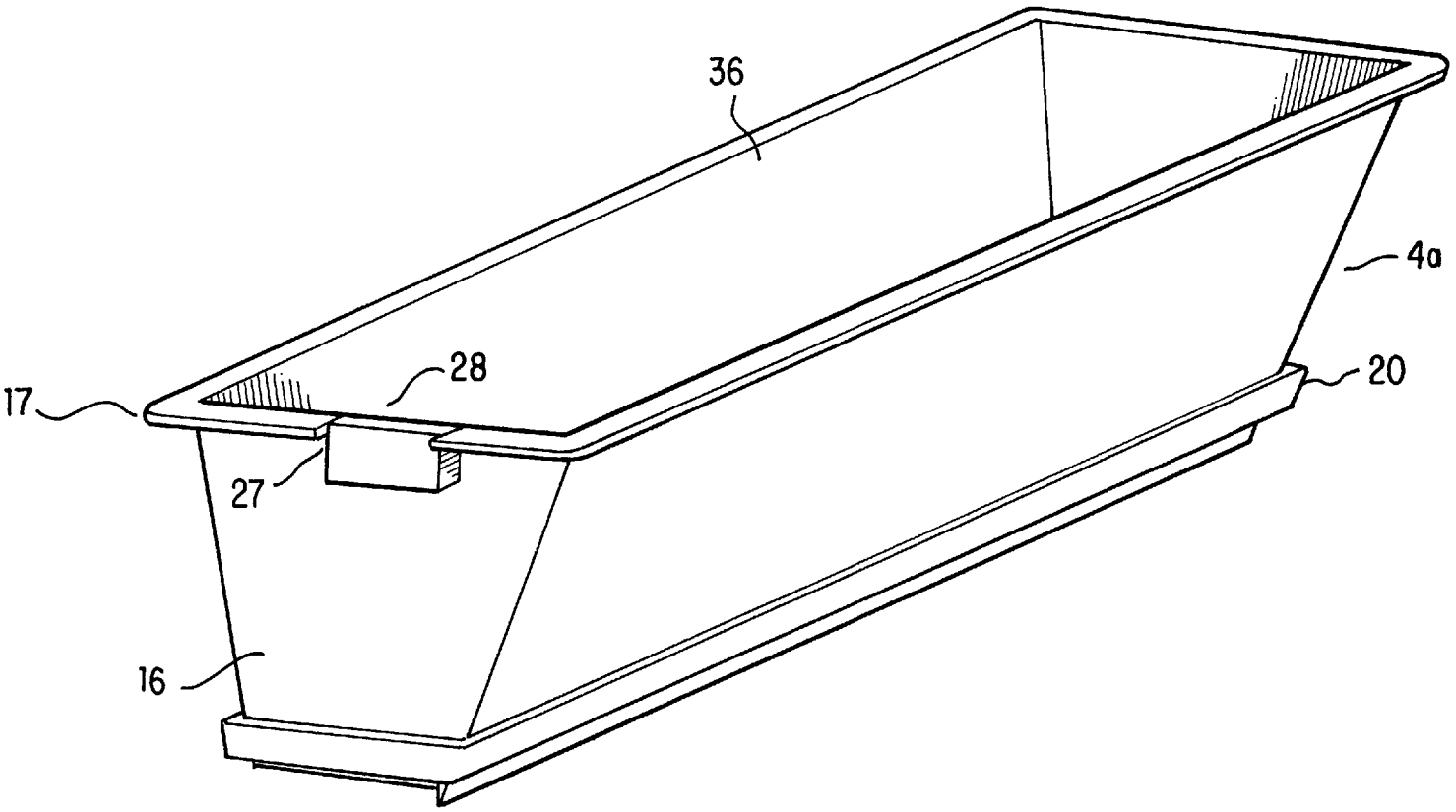
FIG. 3 is a perspective view of a container used in an embodiment of the apparatus for dispensing toner.

Installation of container 4*b* into container 4*a*, previously installed in housing 3, is accomplished by positioning the bottom of container 4*b* over top seal 14 of container 4*a* and forcing sharp edge 21 of container 4*b* into top seal 14. Because replenishment container 4*b* is installed only when container 4*a* is depleted of toner, there will not be compaction of toner resulting from the installation of container 4*b* into container 4*a*. The force of sharp edge 21 on top seal 14 ruptures top seal 14 of container 4*a* and allows container 4*b* to be stacked into container 4*a*. In the preferred embodiment, sharp edge 21 spans the length of sidewall 16 as shown in FIG. 3. However, one skilled in the art will recognize that it is not necessary for sharp edge 21 to span the entire length of container 4*b* to accomplish the rupturing of top seal 14. Sharp edge 21 may be comprised of several segments spaced over the length of container 4*b* or a single segment centered along the length of container 4*b*, or sharp edge 21 may be implemented as a sharp point. One skilled in the art will further recognize that sharp edge 21 may be orientated in a variety of directions with respect to the longitudinal axis of container 4*b* and accomplish the rupturing of top seal 14. Additionally, if container 4*b* is pushed down onto top seal 14 with sufficient force, it is not necessary that sharp edge 21 be present to rupture top seal 14.

Figure 10:
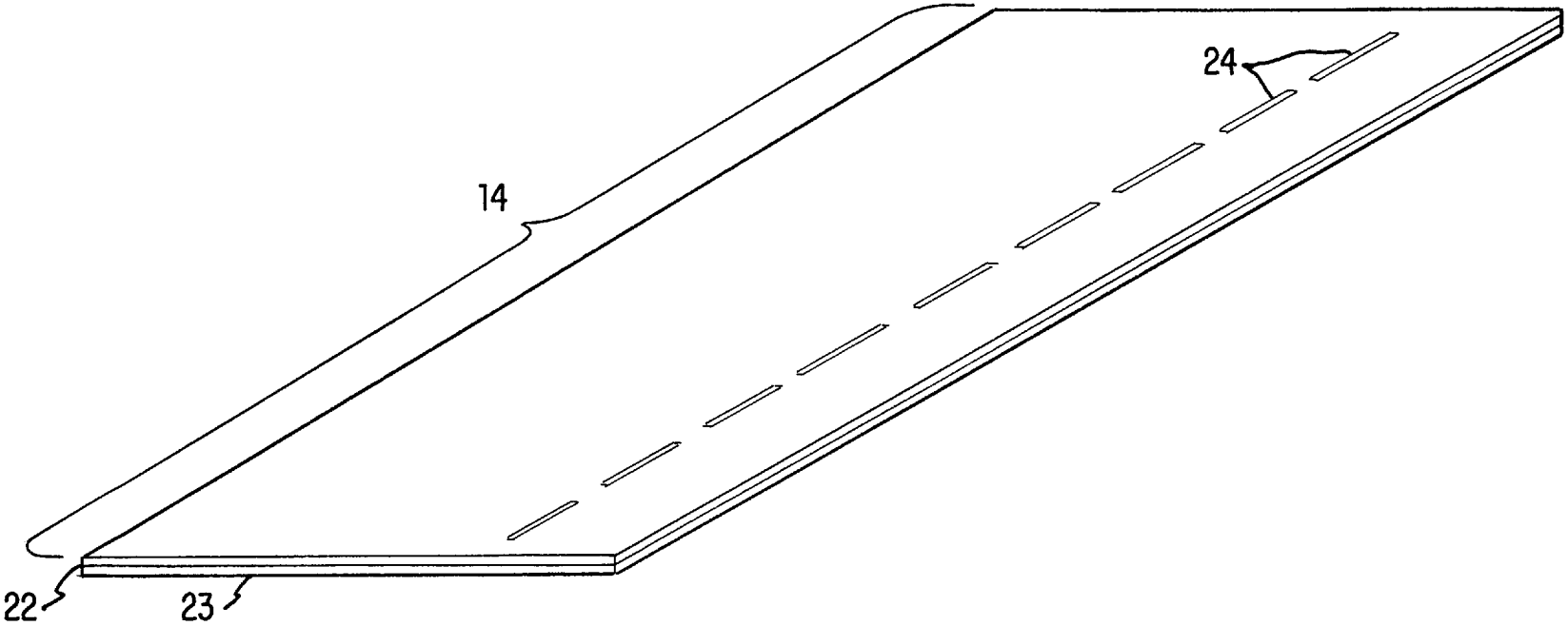
FIG. 10 is a perspective view of the top seal for the replenishing container.

Referring particularly to FIG. 10, In the preferred embodiment, top seal 14 is comprised of a first layer 22 of flexible clear plastic material, such as polycarbonate, thermally bonded to a second layer 23 of flexible clear plastic material, such as MYLAR. The layers can also be ultrasonically bonded or bonded with an adhesive. First layer 22 is comprised of material of greater tensile strength than second layer 23. In the preferred embodiment, first layer 22 is perforated 24 along a line corresponding to the position at which sharp edge 21 would be located when positioned over top seal 14 for installation. Top seal 14 ruptures at perforation 24 when sharp edge 21 of container 4*b* is forced into perforation 24. In the preferred embodiment, as container 4*b* is inserted into container 4*a*, ruptured top seal 14 contacts sidewall 16 and inhibits toner from escaping from container 4*a* through top opening 36. The second layer 23 of top seal 14, comprised of a material of lesser tensile strength than first layer 22, does not require perforation in order to be ruptured by sharp edge 21 and is not perforated to prevent toner leakage. The edges of the second layer 23 of top seal 14 are bonded to the top surface of outer flange 17. One skilled in the art will recognize that a variety of methods may be used to accomplish the bonding. Second layer 23 of top seal 14 can be bonded to the top surface of outer flange 17 using an adhesive, an ultrasonic process, or a thermal process.

Toner dam seal 15 is comprised of a flexible material bonded to the bottom edge of sidewall 16. In the preferred embodiment, toner dam seal 15 is comprised of a sheet of flexible clear plastic material, such as MYLAR. One skilled in the art will recognize that a variety of methods may be used to accomplish the bonding. An adhesive may be used for bonding toner dam seal 15 to the bottom edge of sidewall 16 or bonding may be accomplished ultrasonically or thermally as is well known in the art.

Figure 4:
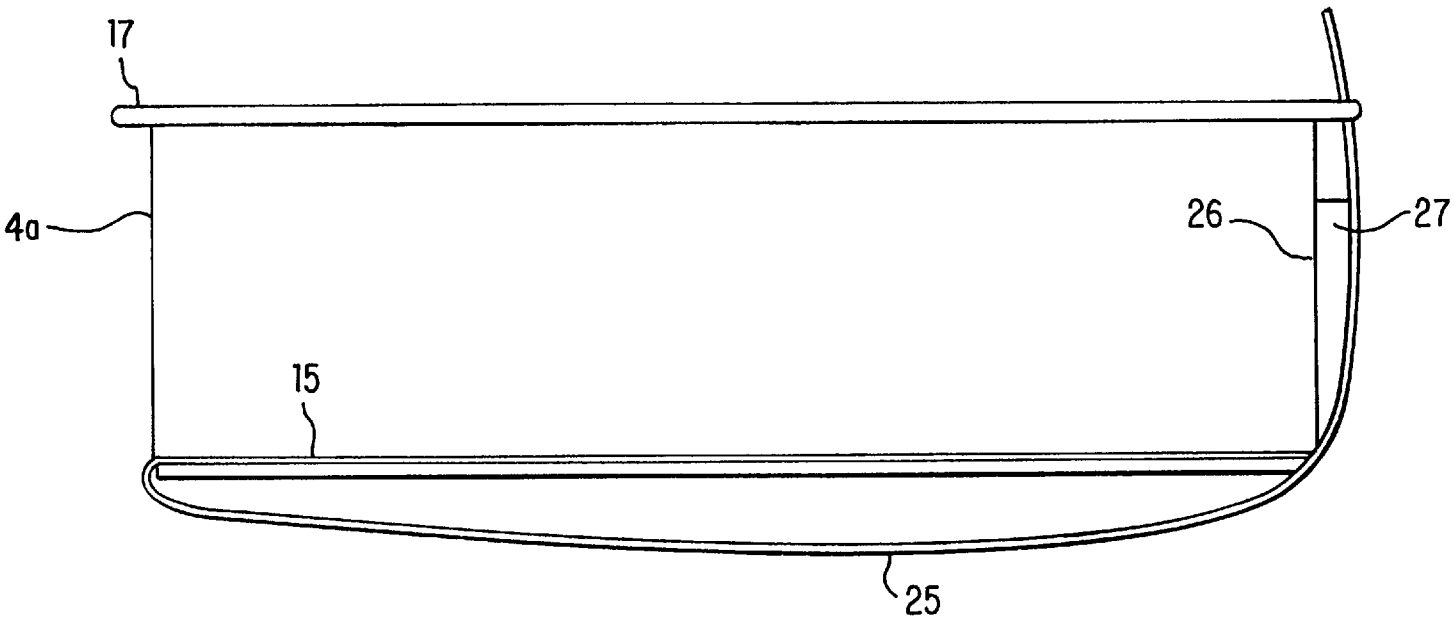
FIG. 4 is a side view of a container used in an embodiment of the apparatus for dispensing toner.

Referring to FIG. 4, a side view of container 4*a* is provided. In the preferred embodiment, included in the toner dam seal 15 is a length of flexible material 25 to assist in the removal of toner dam seal 15. Length of flexible material 25 is sufficiently long to allow it to fold back and be routed along the bottom of container 4*a*, around the bottom corner of container 4*a*, and along sidewall 26 past outer flange 17 of container 4*a*. In the preferred embodiment, length of flexible material 25 is comprised of a flexible plastic material, such as MYLAR, and is integrally formed with toner dam seal 15.

Referring to FIG. 3, a perspective view of container 4*a* is shown. Outer flange 17 includes a notch 27 filled by notch seal 28. When container 4*a* is installed in housing 3, length of flexible material 25 (shown in FIG. 4) is folded back, routed along the bottom of container 4*a*, around the bottom corner of container 4*a*, along sidewall 16, over notch seal 28, and past outer flange 17.

Notch 27 in outer flange 17 provides a gap through which length of flexible material 25 can be routed. Notch seal 28 prevents toner migration through notch 27 in outer flange 17 after removal of toner dam 15.

Removal of toner dam seal 15 is performed after container 4*a* is installed into housing 3 and top toner seal 18 is seated on inner flange 12*a*, 12*b* or after container 4*b* is installed in housing 3 and top toner seal 18 is seated on the top surface of the outer flange 17 of the previously installed container 4*a*. Removal of toner dam seal 15 is accomplished by firmly pulling on length of flexible material 25 which causes toner dam seal 15 to peel away from the bottom of housing 3. Toner flows through the opening created by the removal toner dam seal 15 to the developer assembly 82.

Figure 6:
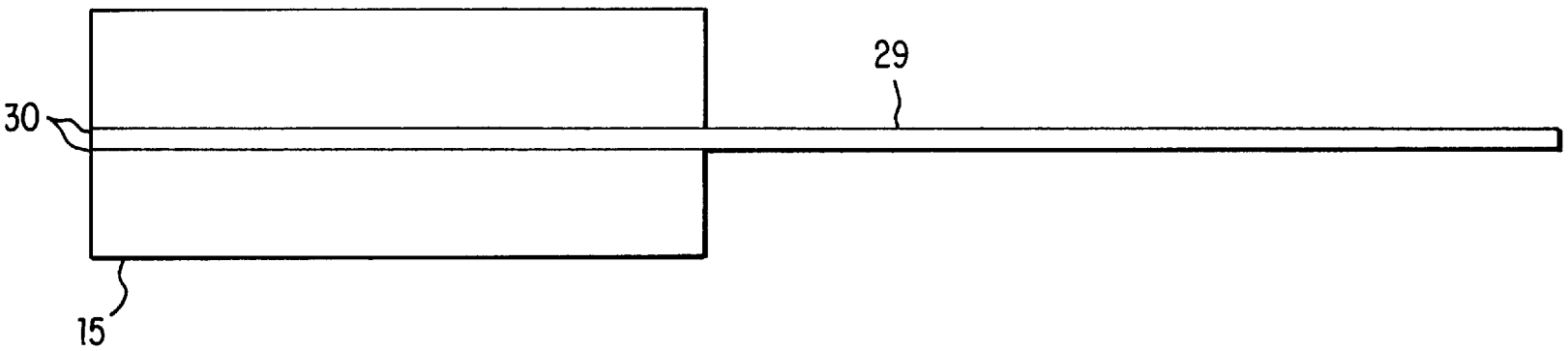
FIG. 6 is an embodiment of a toner dam seal.

Referring to FIG. 6, another embodiment of toner dam seal 15 is shown. Toner dam seal 15 includes a strip of flexible plastic material 29 joined with the material of the toner dam seal 15. Toner dam seal 15 is bonded to container 4*a* so that flexible plastic strip 29 protrudes from the end of container 4*a* opposite notch seal 28. During installation of container 4*a* into housing 3, flexible plastic strip 29 is looped underneath container 4*a*, routed along the bottom of container 4*a*, around the bottom corner 4*a*, along sidewall 16, and over notch seal 28, and past outer flange 17. Flexible plastic strip 29 is joined with toner dam seal 15 so that there is a weakened seam 30 on either side of flexible plastic strip 29 over the length of toner dam seal 15 attached to flexible plastic strip 29. Opening of toner dam seal 15 is accomplished by firmly pulling on flexible plastic strip 29 which tears flexible plastic strip 29 away from toner dam seal 15 at weakened seam 30. When flexible plastic strip 29 is torn away, toner dam seal 15 splits and allows toner flow to developer assembly 82.

Figure 11:
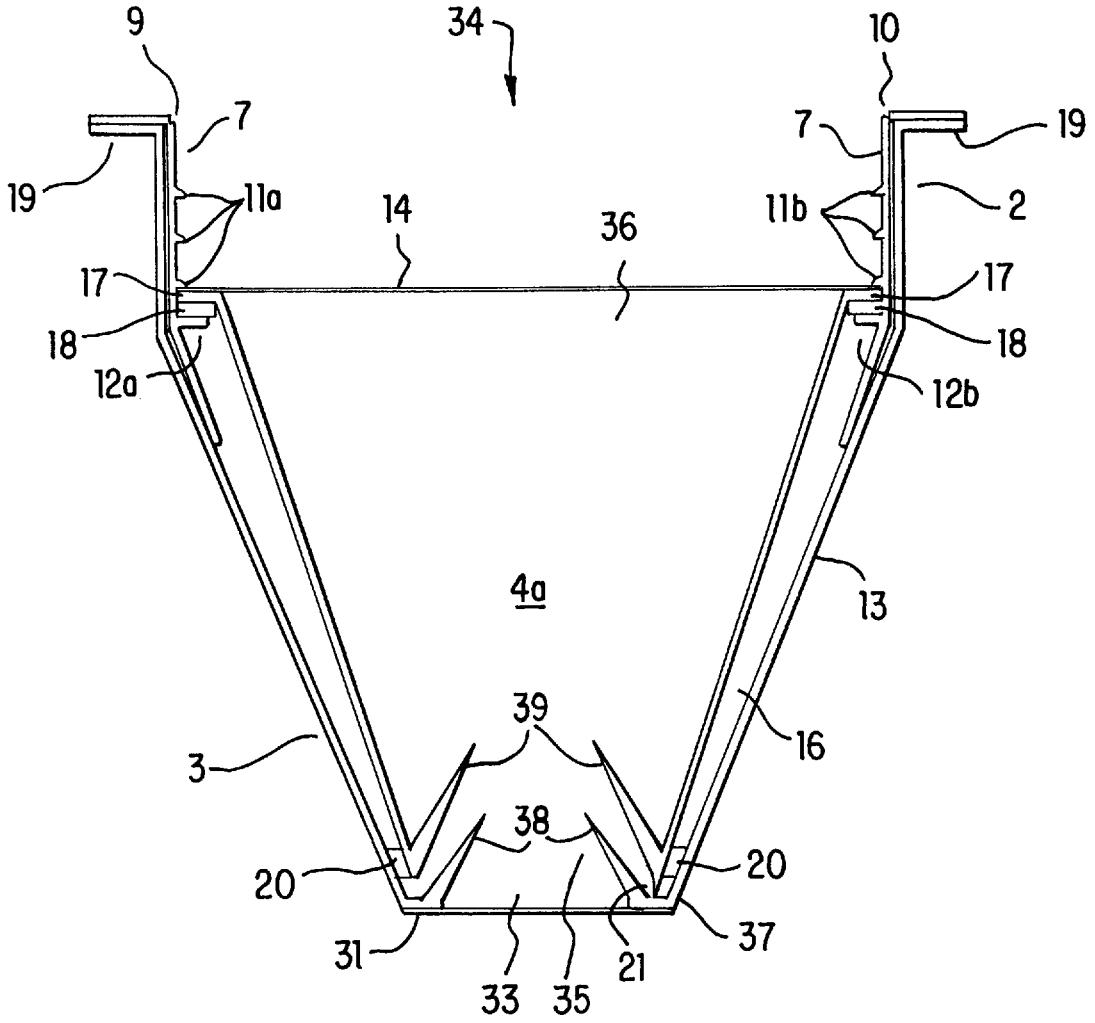
FIG. 11 is a cross section of an alternative embodiment of the apparatus for dispensing toner.

An alternative embodiment of the apparatus for dispensing toner is shown in FIG. 11. Housing cutting blades 38 are attached to housing 3 at the bottom edge of sidewall 13. Container cutting blades 39 are attached to container 4*a* at the bottom edge of sidewall 16. FIG. 11 is a cross section of an alternative embodiment of the apparatus for dispensing toner showing both housing cutting blades 38 and container cutting blades 39 at the cross section. Housing cutting blades 38 puncture and cut open toner dam seal 15 (not shown in FIG. 11) when container 4*a* is installed in housing 3, allowing toner to reach developer assembly 82. A plurality of pairs of both housing cutting blades 38 and container cutting blades 39 are present over the length, respectively, of housing 3 and container 4*a* to cut open toner dam seal 15 over the length of container 4*a*. In the alternative embodiment of the apparatus for dispensing toner, toner dam seal 15 does not have an attached length of flexible material 25 for removal. Housing 38 and container 39 cutting blades are preferably integrally formed, respectively, into sidewall 13 and sidewall 16.

Figure 7:
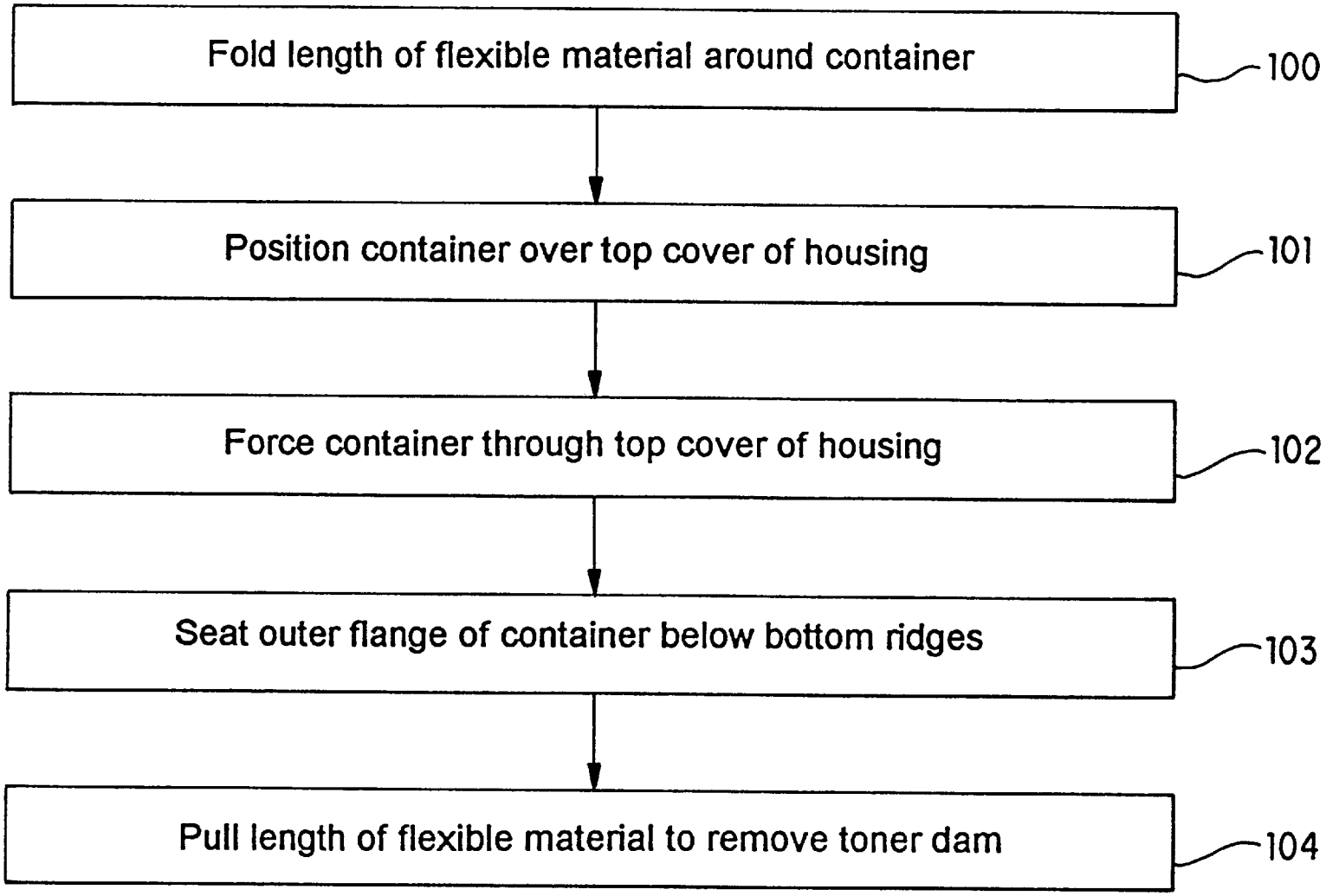
FIG. 7 is a flow diagram of a method for inserting a first replenishment container into the apparatus for dispensing toner.

Referring to FIG. 7, installation of the preferred embodiment of container 4*a* into the apparatus for dispensing toner 2 is accomplished as follows: Length of flexible material 25 (shown in FIG. 4) is folded 100 under container 4*a*, routed along the bottom of container 4*a*, around the bottom corner of container 4*a*, along sidewall 16, over notch seal 28, and past outer flange 17. Container 4*a* is positioned 101 over top cover 7 of housing 3. Container 4*a* is forced 102 through top cover 7 into housing 3 so that top cover 7 is split at seam 8 and bends at hinges 9, 10 into the interior of housing 3. Outer flange 17 is seated 103 below the bottom most of locking ridges 11*a*, 11*b* so that top toner seal 18 is disposed upon inner flange 12*a*, 12*b*, while length of flexible material 25 is held in place. Bottom most of locking ridges 11*a*, 11*b* force top toner seal 18 onto inner flange 12*a*, 12*b*, holding container 4*a* in place. Length of flexible material 25 is firmly pulled 104 to remove toner dam seal 15 and allow toner to reach developer assembly 82.

Figure 8:
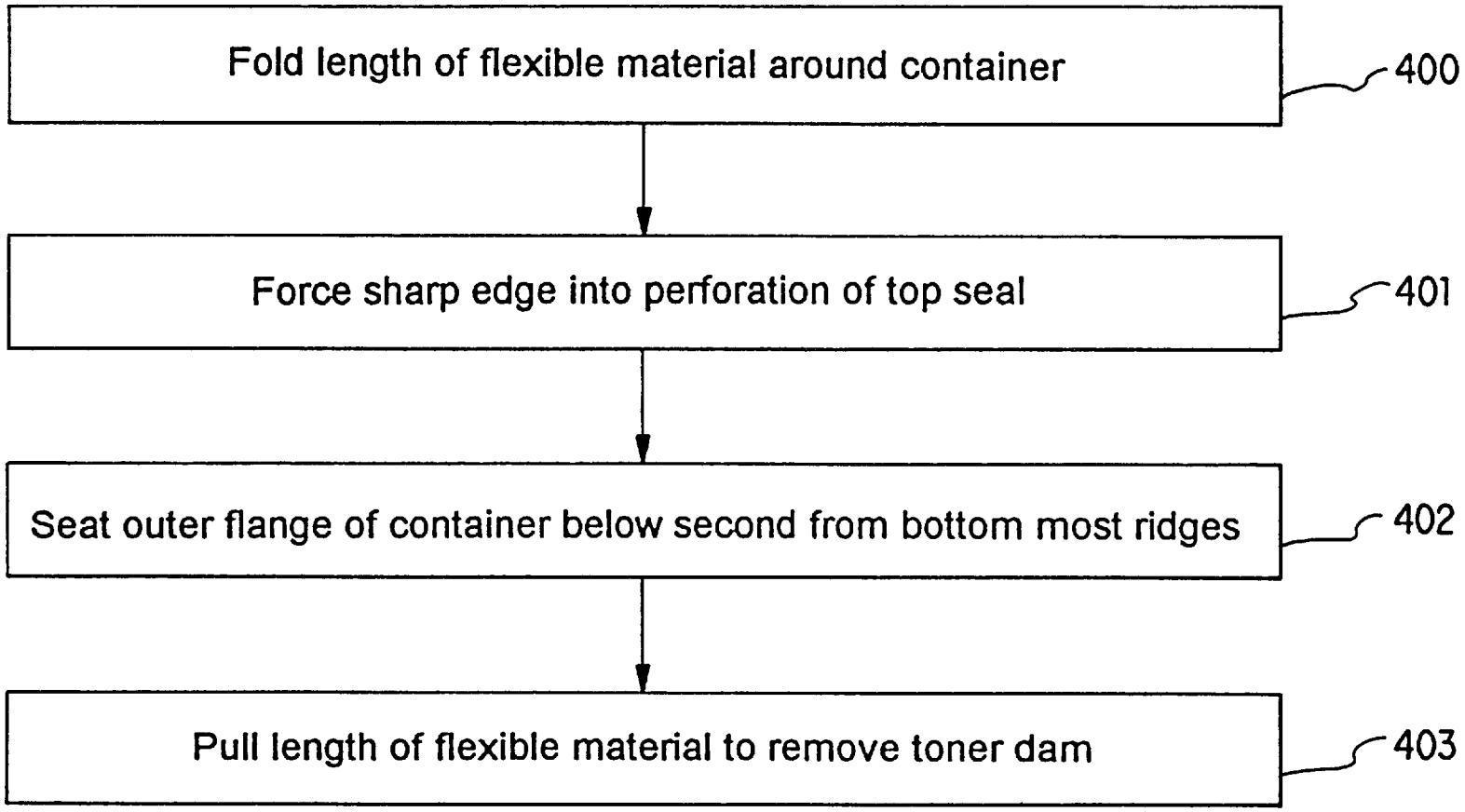
FIG. 8 is a flow diagram of a method for inserting a second and subsequent container into the apparatus for dispensing toner.

Referring to FIG. 8, installation of the preferred embodiment of container 4*b* into the apparatus for dispensing toner 2 is accomplished as follows: Length of flexible material 25 (shown in FIG. 4) is folded 400 under container 4*b* , routed along the bottom of container 4*b*, around the bottom corner of container 4*b*, along sidewall 16, over notch seal 28, and past outer flange 17. Sharp edge 21 is forced 401 down upon the perforation 24 of top seal 14 of container 4*a*, thereby splitting top seal 14 at perforation 24. Outer flange 17 is seated 402 below second from bottom most locking ridges 11*a*, 11*b* so that top toner seal 18 is disposed upon outer flange 17 of container 4*a*, while length of flexible material 25 is held in place. Second from bottom most of locking ridges 11*a*, 11*b* force top toner seal 18 onto outer flange 17 of container 4*b*. Length of flexible material 25 is firmly pulled 403 to remove toner dam seal 15 and allow toner to reach developer assembly 82.

Figure 12:
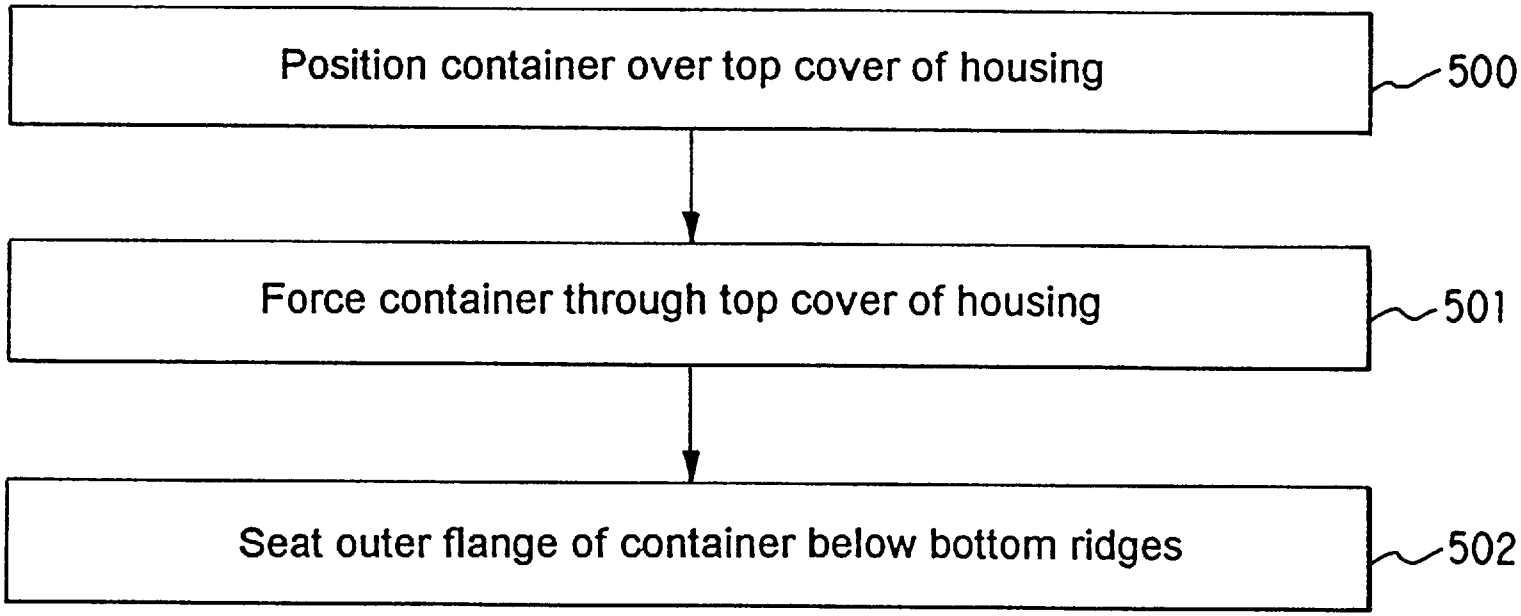
FIG. 12 is a flow diagram of a method for inserting an alternative container into the apparatus for dispensing toner.

Referring to FIG. 12, installation of container 4*a* of into the alternative embodiment of the apparatus for dispensing toner 2 employing housing cutting blades 38 and container cutting blades 39 is accomplished as follows: Container 4*a* is positioned 500 over top cover 7 of housing 3. Container 4*a* is forced 501 through top cover 7 into housing 3 so that top cover 7 is split at weakened seam 8 and bends at hinges 9, 10 into the interior of housing 3. Outer flange 17 is seated 502 below the bottom most of locking ridges 11*a*, 11*b* so that top toner seal 18 is disposed upon inner flange 12*a*, 12*b*. This seating operation results in toner dam seal 15 being punctured and cut open by housing cutting blades 38, allowing toner to reach developer assembly 82. Bottom most of locking ridges 11*a*, 11*b* force top toner seal 18 onto inner flange 12*a*, 12*b*, holding container 4*a* in place.

Figure 13:
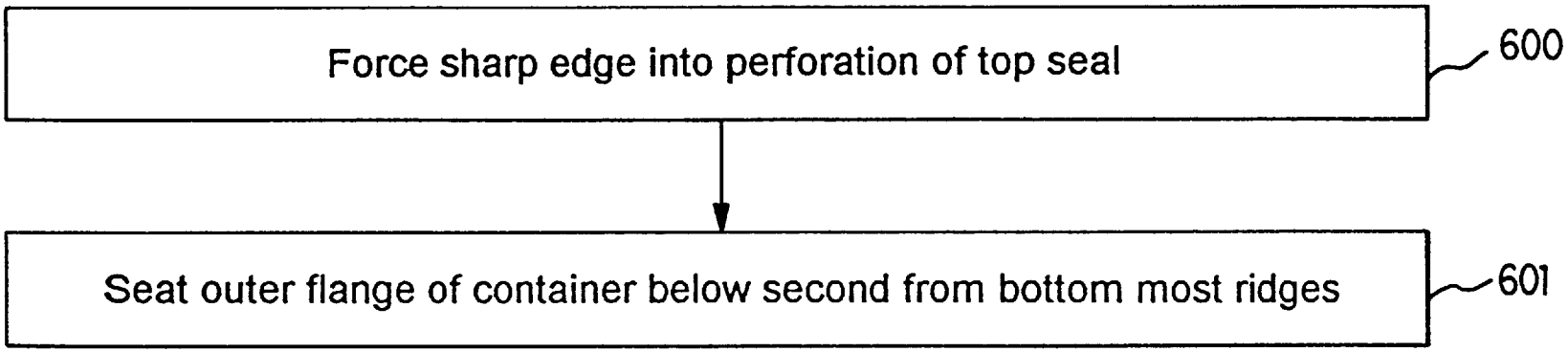
FIG. 13 is a flow diagram of a method for inserting a second and subsequent alternative container into the apparatus for dispensing toner.

Referring to FIG. 13, installation of the container 4*b* into the alternative embodiment of the apparatus for dispensing toner 2 employing housing cutting blades 38 and container cutting blades 39 is accomplished as follows: Sharp edge 21 is forced 600 down upon the perforation 24 of top seal 14 of container 4*a*, thereby rupturing top seal 14 at perforation 24. Outer flange 17 is seated 601 below second from bottom most locking ridges 11*a*, 11*b* so that top toner seal 18 is disposed upon outer flange 17 of container 4*a*. This seating operation results in toner dam seal 15 being punctured and cut open by container cutting blades 39, allowing toner to reach developer assembly 82. Second from bottom most of locking ridges 11*a*, 11*b* force top toner seal 18 onto outer flange 17 of container 4*a*.

Although an embodiment of the invention has been illustrated, and that form described, it is readily apparent to those skilled in the art that various modifications may be made therein without departing from the spirit of the invention or from the scope of the appended claims.

What is claimed is:

1. A first apparatus for containing toner adapted for installation into an apparatus for dispensing toner and adapted for installation of a substantially identical second apparatus for containing toner into said first apparatus for containing toner, said first apparatus for containing toner, comprising:

a container having a sidewall, a top having a first opening, and a bottom having a second opening, said first opening dimensioned to permit insertion of said bottom of said second apparatus for containing toner through said first opening, said sidewall includes a top edge, a bottom edge, and an exterior surface, said sidewall defines an interior region of said container, said container includes an outer flange attached to said exterior surface of said sidewall at said top edge, said outer flange having a bottom surface and projecting away from said interior region;

an openable top seal including a first sheet attached to a second sheet closing said first opening, said first sheet constructed of a first material, said second sheet constructed of a second material, said first material having a tensile strength greater than that of said second material, said first sheet having a perforation therein for enabling rupturing of said first sheet, said second sheet attached to said outer flange; and a toner dam seal attached to said bottom edge of said sidewall.

2. The first apparatus for containing toner as recited in claim 1, further comprising:

a cutting blade attached to said sidewall in said interior region orientated for cutting said toner dam seal of said second apparatus for dispensing toner upon installation into said first apparatus for containing toner.

3. The first apparatus for containing toner as recited in claim 1, further comprising:

a means for rupturing said top seal at said perforation.

4. The first apparatus for containing toner as recited in claim 3, wherein:

said means for rupturing includes a rib having an edge, said rib attaches to said bottom edge of said sidewall with said edge projecting away from said bottom edge of said sidewall.

5. The first apparatus for containing toner as recited in claim 4, further comprising:

a top toner seal attached to said bottom surface of said outer flange; and a bottom toner seal attached to said exterior surface of said sidewall adjacent to said bottom edge of said sidewall.

6. The first apparatus for containing toner as recited in claim 5, further comprising:

a notch in said outer flange; and a toner notch seal attached to said exterior surface of said sidewall at said notch.

7. The first apparatus for containing toner as recited in claim 6, wherein:

said toner dam seal removably attaches to said container; and said toner dam seal includes a length of flexible material, not attached to said container, extending beyond said second opening of said container.

8. The first apparatus for containing toner as recited in claim 6, wherein:

said toner dam seal removably attaches to said container;

said toner dam seal includes a third sheet having a first part and a second part, said third sheet closes said second opening of said container; and said toner dam seal includes a flexible strip extending from said third sheet and joined to and between said first and said second part of said third sheet forming a first seam and a second seam on each side of said flexible strip to allow tearing of said flexible strip from said first and said second part of said third sheet at said first and said second seam.

9. An apparatus for dispensing toner to a developer assembly in an electrophotographic printing system, said apparatus comprising:

a housing for containing said toner having a first sidewall defining a first interior region, a first top having a first opening, and a first bottom having a second opening, said first top of said housing disposed above said developer assembly in said electrophotographic printing system;

an openable top cover attached to said housing and closing said first opening;

a removable housing toner seal attached to said housing and closing said second opening;

a first container for containing said toner, said first container for installation into said housing through said first opening to replenish said toner when said first interior region becomes depleted of said toner, said first container having a second sidewall, a second top having a third opening, and a second bottom having a fourth opening, said second bottom dimensioned to permit insertion of said second bottom through said first opening of said housing;

an openable top seal attached to said first container and closing said third opening;

a toner dam seal attached to said first container and closing said fourth opening of said first container;

a second container substantially identical to said first container, said third opening of said first container dimensioned to permit insertion of a third bottom of said second container through said third opening of said first container when said first container becomes depleted of said toner;

a weakened seam bisecting said top cover, said weakened seam splits preferentially with the application of downward force to said top cover;

a pair of inner flanges attached to said top cover, one of said pair of inner flanges located on each side of said weakened seam; and at least one pair of locking ridges attached to said top cover, one half of said locking ridges located on said top cover on each side of said weakened seam.

10. The apparatus for dispensing toner as recited in claim 9, further comprising:

a pair of hinge grooves formed in said top cover for allowing said top cover, when split at said weakened seam, to bend into said first interior region, one of said pair of hinge grooves located on each side of said weakened seam.

11. The apparatus for dispensing toner as recited in claim 10, wherein:

attachment of each of said pair of inner flanges to said top cover occurs symmetrically about said weakened seam;

attachment of said locking ridges to said top cover occurs symmetrically about said weakened seam at greater distance from said weakened seam than said pair of inner flanges; and forming of said pair of hinge grooves in said top cover occurs symmetrically about said weakened seam at a greater distance from said weakened seam than said locking ridges.

12. The apparatus for dispensing toner as recited in claim 11, wherein:

said first sidewall includes a first top edge and a first bottom edge; and said housing includes a bottom housing flange attached to said first bottom edge of said first sidewall, said housing toner seal attaches to said bottom housing flange; and said housing includes a top housing flange attached to said first top edge of said sidewall, said top cover attaches to said top housing flange.

13. The apparatus for dispensing toner as recited in claim 12, wherein:

said second sidewall defines a second interior region;

said second sidewall includes a second top edge and a second bottom edge;

said first container includes an outer flange having a bottom surface attached to said second top edge of said second sidewall and;

said top seal attaches to said outer flange.

14. The apparatus for dispensing toner as recited in claim 13, further comprising:

a top toner seal attached to said bottom surface of said outer flange of said first container; and a bottom toner seal attached to said second sidewall of said first container adjacent to said second bottom edge of said first container and exterior to said second interior region of said container.

15. The apparatus for dispensing toner as recited in claim 14, further comprising:

a means for rupturing said top seal of said first container installed in said housing.

16. The apparatus for dispensing toner as recited in claim 15, further comprising:

a first cutting blade attached to said first sidewall of said housing in said first interior region orientated for cutting said toner dam seal of said first container upon installation into said housing;

a second cutting blade attached to said second sidewall of said first container in said second interior region orientated for cutting said toner dam seal of said second container upon installation into said first container.

17. The apparatus for dispensing toner as recited in claim 15, wherein:

said toner dam seal removably attaches to said first container; and said toner dam seal includes a length of flexible material not attached to said first container extending beyond said fourth opening of said first container.

18. The apparatus for dispensing toner as recited in claim 17, further comprising:

a notch in said outer flange of said first container; and a toner notch seal attached to said sidewall at said notch in said outer flange of said first container.

19. In an electrophotographic printing system using an apparatus for dispensing toner to a developer assembly having a housing for containing toner, said housing having a top cover with a weakened seam, said apparatus for dispensing toner using at least one toner filled container for installation into said housing for replenishment of said toner, said container having a toner dam seal, a top seal, a bottom, and a rib having an edge protruding from said bottom, a method for replenishing said toner of said apparatus for dispensing toner, comprising the steps of:

forcing said container downward onto said top cover of said housing splitting said weakened seam, when said housing depleted of said toner;

seating said container in said housing; and opening said toner dam seal.

20. The method as recited in claim 19, further comprising:

said opening step including manually removing said toner dam seal from said container previously installed in said apparatus for dispensing toner;

rupturing said top seal of said container previously installed in said apparatus for dispensing toner using said edge protruding from said bottom of another of said container, when previously installed said container depleted of said toner; and seating another of said container in previously installed said container depleted of said toner; and removing said toner dam seal from another of said container manually.

21. In said housing and said container of said apparatus for dispensing toner having a first cutting blade and a second cutting blade, respectively, the method as recited in claim 19, further comprising the steps of:

said opening step including cutting said toner dam seal using said first cutting blade;

rupturing said top seal of said container previously installed in said apparatus for dispensing toner using said edge protruding from said bottom of another of said container, when previously installed said container depleted of said toner;

seating another of said container in previously installed said container depleted of said toner; and opening said toner dam seal of another of said container by cutting said toner dam seal using said second cutting blade of previously installed said container.

* * * * *